United States Patent [19]

Daly

[11] 4,051,555

[45] Oct. 4, 1977

[54] PROTECTIVE HEADWEAR

[75] Inventor: Noel Daly, New Plymouth, New Zealand

[73] Assignee: E.D. Bullard Company, Sausalito, Calif.

[21] Appl. No.: 749,247

[22] Filed: Dec. 10, 1976

[30] Foreign Application Priority Data

Dec. 19, 1975 New Zealand ..... 179613

[51] Int. Cl.[2] ..... A42B 3/02

[52] U.S. Cl. ..... 2/412; 2/425; 2/6

[58] Field of Search ..... 2/412, 410, 411, 425, 2/417, 414, 6

[56] References Cited

U.S. PATENT DOCUMENTS

| | | | |
|---|---|---|---|
| 2,289,345 | 7/1942 | Craig et al. | 2/6 |
| 3,286,275 | 11/1966 | Marchello | 2/411 |
| 3,829,900 | 8/1974 | Marangoni | 2/414 |
| 3,935,044 | 1/1976 | Daly | 2/412 X |
| 3,946,441 | 3/1976 | Johnson | 2/412 |

FOREIGN PATENT DOCUMENTS

| | | | |
|---|---|---|---|
| 894,251 | 4/1962 | United Kingdom | 2/414 |

*Primary Examiner*—Alfred R. Guest
*Attorney, Agent, or Firm*—Phillips, Moore, Weissenberger, Lempio & Majestic

[57] ABSTRACT

A protective helmet comprising a shock absorbing shell is disclosed in which a recess is provided at the inner apex or crown portion of the shock absorbing shell and a laminated insert of padding providing for both wearer comfort and shock attenuation is placed in such recess. The design of the recess and insert to provide specific shock attenuating characteristics is described.

15 Claims, 4 Drawing Figures

PROTECTIVE HEADWEAR

BACKGROUND OF THE INVENTION

This invention relates to protective headwear providing a barrier between the head of a wearer and any means whereby the head of the wearer may be injured and more particularly to improvements in the shock absorbing structure of protective helmets providing greater wearer comfort with additional shock attenuation.

Protective helmets are widely used in industry and the armed forces and as crash helmets, equestrian helmets, ski helmets, cyclist's helmets and the like. Such helmets comprise a shell designed to distribute the load of any localized shock over a larger area. The helmet is supported by the head of the wearer in use and various means have been provided for such support in order to provide comfort to the wearer while continuing to provide the desired protection.

For example, a sling or harness of webbing or other material has been fastened to a lower inner portion of the helmet with dimensions and an arrangement such that when the sling or harness is in contact with the head of the wearer, the helmet is supported about the head with a clearance between the shell and the head. Since the sling or harness tends to concentrate the weight of the helmet or the load of a shock thereon at specific areas of the head, it is also known to provide the interior of the shell with protective padding fixed or secured in some manner to the shell and arranged to bear against the head with or without a sling or harness.

In general, the different types of padding used in protective helmets fall in two categories: "comfort padding" which is used merely to provide for wearer comfort and fit, but plays little part in the shock attenuating characteristics of the helmet; and "shock absorbing padding" which is much denser and is designed to attenuate shock, and to spread shock loads over a greater area of the head.

It is a primary object of this invention to provide protective headwear having a shock absorbing structure which utilizes both types of padding to achieve both additional shock attenuation and additional comfort.

It is a further object of this invention to provide a helmet having a shock absorbing structure including a simple, inexpensive, easily replaceable fitting at the inner apex or crown thereof providing for improved hygiene, greater wearer comfort and additional shock attenuation.

SUMMARY OF THE INVENTION

Briefly, this invention provides an improvement in protective headwear adapted to surround at least a substantial cranial portion of the head of the wearer and comprising a shock absorbing shell including a thin wall outer shell of tough non-brittle material, a thin wall inner shell of tough non-brittle material fitted witin the outer shell and spaced therefrom and a relatively thick walled shell of shock absorbing padding filling the space between the inner and outer thin wall shells. According to this invention, the improvement comprises a recess at the inner apex of the thin wall inner shell extending substantially through the thickness of the thick walled shell of shock absorbing passing. The recess has an area which is a substantial portion only of the average area of the crown of the human skull. An insert member for the recess comprising a generally planar member made of comfort padding and a generally planar member made of shock absorbing padding each having one major surface adhered to one major surface of the other is provided. The member of comfort padding has major surfaces of larger area than the recess and the member of shock absorbing padding has major surfaces of smaller area than the area of the major surfaces of the member of comfort padding and is centered on one major surface of the member of comfort padding. In use the member of shock absorbing padding is received within the recess with the extending edges of the member of comfort padding in contact with the interior of the thin wall inner shell and the other major surface thereof exposed to contact by the head of the wearer.

BRIEF DESCRIPTION OF THE DRAWING

The foregoing and other objects and features of this invention will be more fully understood from the following detailed description of a preferred embodiment thereof when read in conjunction with the appended drawing wherein.

DESCRIPTION OF PREFERRED EMBODIMENTS

Figure 1:
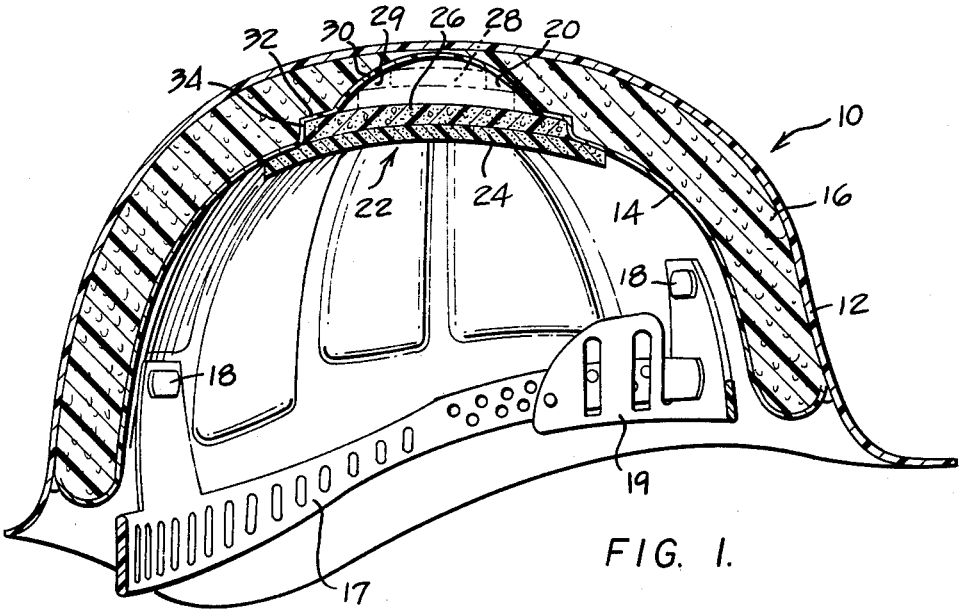
FIG. 1 is a cross-sectional view of a helmet made in accordance with a preferred embodiment of the teaching of this invention.
Figure 2:
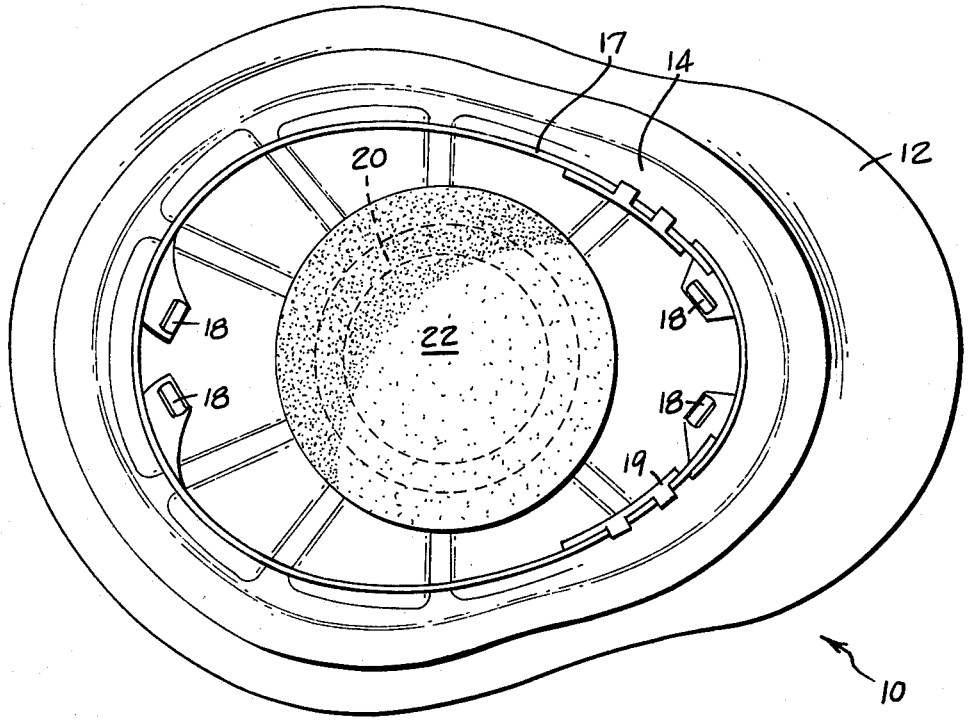
FIG. 2 is a bottom view of the helmet of FIG. 1.

Referring to FIG. 1, a cross-sectional view of protective headwear in the form of a helmet 10 to which the teaching of this invention may be applied with advantage is shown. Basically, the helmet 10 comprises a shock absorbing shell designed and dimensioned to surround at least a substantial cranial portion of the person wearing the helmet 10.

The shock absorbing shell comprises a thin wall outer shell 12 of tough non-brittle material and a thin wall inner shell 14 of though non-brittle material fitted within the outer shell 12 and spaced therefrom with a relatively thick walled shell of shock absorbing padding 16 filling the space between the outer shell 12 and the inner shell 14. The inner shell 14 is designed and dimensioned to accommodate a wearer having a head size at the large end of the range of normal human head sizes and for the comfort of the wearer is provided with a headband 17 mounted within the shock absorbing shell by attachment means 18 and including adjustment means 19 which enables the headband to be adjusted in size to fit wearers having head sizes throughout the normal range thereof.

According to preferred embodiments of the teaching of this invention, the inner shell 14 may be made from one of a variety of plastic materials, either by thermoforming or injection molding or rotational casting. The inner shell generally should be made of a material which is tough and non-brittle and preferably resistant to body oils and perspiration as well as being compatible with the type of shock absorbing padding used to fill the space between the inner shell 14 and the outer shell 12. The outer shell 12 is made of a tough and non-brittle material that also should be compatible with the type of shock absorbing padding 16 used. The outer shell serves to spread the load of any shock over a larger area and also protects the shock absorbing padding 16 and other components of the helmet from mechanical damage. Thus the outer shell may be made of metal or plastic of sufficient thickness to provide the required protection and generally has a wall thickness greater than the wall thickness of the inner shell 14. The inner shell 14 acts as a protective containing barrier for the shock absorbing padding and assists in distributing shock over all or nearly all of the helmet.

The shock absorbing padding 16 may comprise a polyurethane or polystyrene foam of selected density and thickness, depending upon the spacing between the facing surfaces of the inner 14 and outer 12 shells. In any event the density and thickness of the shock absorbing padding 16 must be sufficient to provide the amount of shock absorption required for a particular type of protective helmet. The outer shell 12, inner shell 14 and shock absorbing padding 16 may or may not be bonded together. By bonding the spaced inner and outer shells together with a bonded light-weight shock absorbing padding, all three elements of the shock absorbing shell contribute to the physical strength of the structure and the performance is improved considerably due to the high strength/weight ratio achieved. In the helmet 10 shown in FIG. 1, the edge of the inner shell 14 is attached to the interior of the outer shell 12 by an appropriate welded or cemented joint therebetween.

According to the teaching of this invention, a recess 20 is provided at the inner apex of the inner shell 14. Such recess 20 extends substantially through the thickness of the thick walled shell of shock absorbing padding 16. An insert member 22 is positioned in the recess 20.

The insert member 22 comprises a generally planar member 24 of comfort padding and at least one generally planar member 26 of shock absorbing padding. One major surface of the member 26 of shock absorbing padding is adhered to one major surface of the member 24 of comfort padding. As is known in the art, the comfort padding of which the member 24 is made may be one of a variety of resilient materials which can continuously contact the head of the wearer without discomfort. For example, the member 24 may be made of rubber, leather, or a light polyurethane or polystyrene foam having appropriate characteristics. The member 26 may be made of a material similar to the shock absorbing padding 16 which fills the space between the outer 12 and inner 14 shells.

Figure 3:
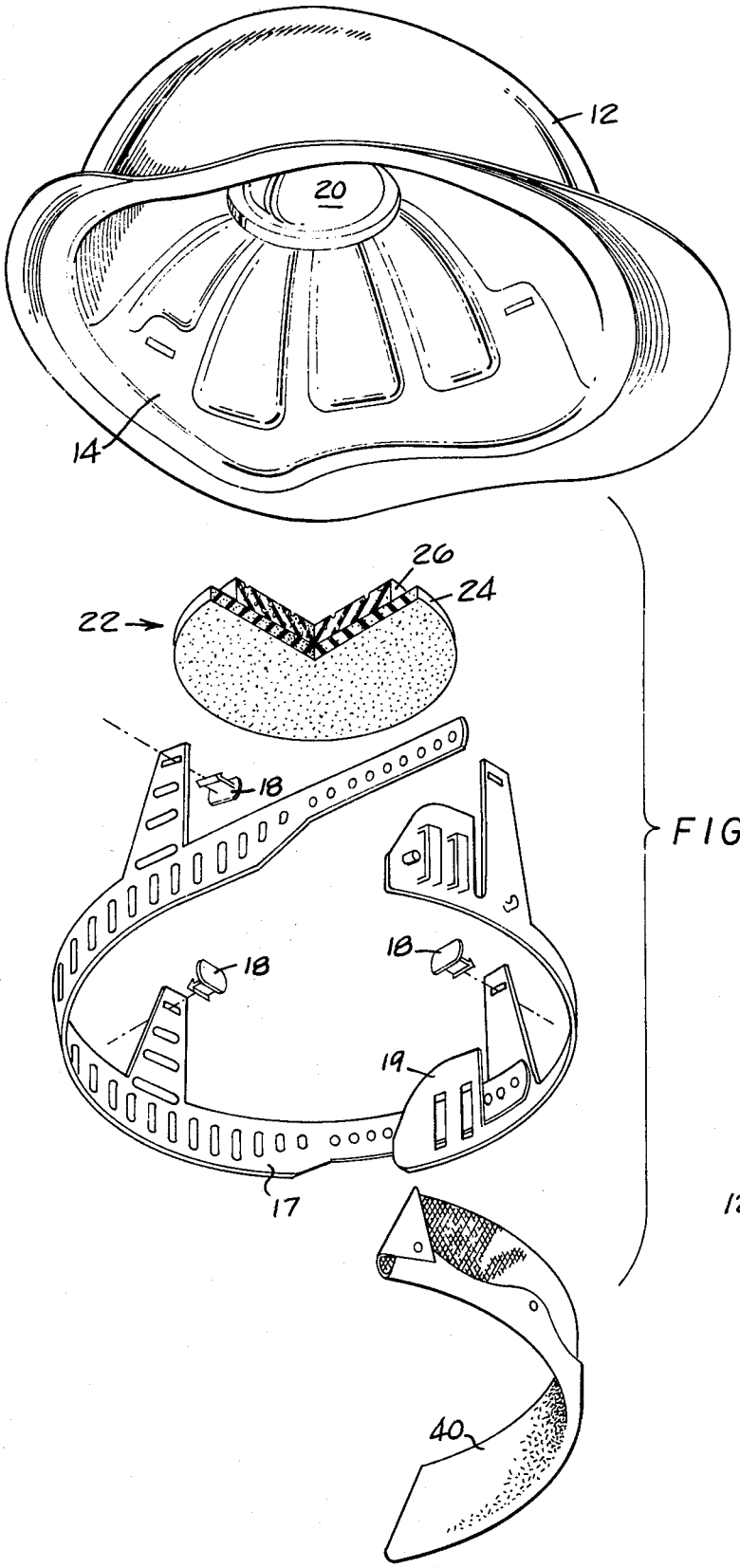
FIG. 3 is an exploded view of the helmet of FIGS. 1 and 2.

The recess 20 has an area at the inner surface of the inner shell 14 which is a substantial portion only of the crown of the human skull. As best shown in FIG. 3, the recess 20 is preferably circular as is the insert member 22. The recess 20 and insert member could be oval or of some other smoothly curved shape but in any event the recess 20 and insert member 22 preferably have corresponding shapes.

As best shown in FIG. 1, the member 24 of the insert 22 has major surfaces of larger area than the area of the recess 20. The member 26 of the insert 22 has major surfaces of smaller area than the member 24 and is preferably centered on the member 24 as best shown in FIG. 3. In preferred embodiments of the teaching of this invention, the member 26 may be dimensioned so that it will be compressively received within the recess 20 to hold the insert 22 in place.

According to preferred embodiments of the teaching of this invention, the recess 20 is provided by forming a dome structure 30 at the apex of the inner shell 14. Such dome structure 30 will tend to distribute the load of any shock which is applied to the outer shell 12 directly over the recess 20 and will provide additional shock absorbing characteristics. Thus, the dome structure 30 preferably includes an outwardly extending land 32 and a downwardly extending flange 34 which is joined to the inner shell 14 at the periphery of the recess 20. On occurrence of a sufficient shock, the dome structure 30 may be deformed by and into the shock absorbing padding 16 to further attenuate the load of the shock.

In order to provide further protection in the event of a shock occurring directly over the recess 20, additional members 28 of shock absorbing padding may be provided within the recess 20 as indicated in dotted lines in FIG. 1. Such additional members 28 of shock absorbing padding preferably have the same shape as the other members of the insert 22 thereby tending to provide voids 29 within the recess 20. Such voids may be designed to provide further shock attenuation upon deformation of the dome structure 30 by allowing for displacement of the material of the members 28.

Figure 4:
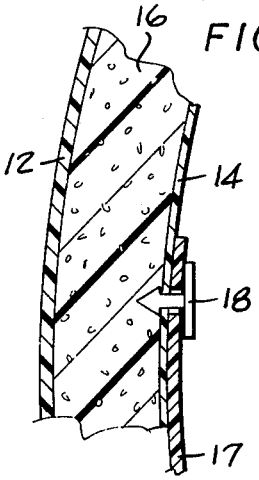
FIG. 4 is an enlarged fragmentary cross-sectional view showing the headband attachment means of the helmet of FIGS. 1–3.

As best shown in FIG. 3, the insert member 22 is a very simple structure which would be easy to manufacture and thus inexpensive. Thus the insert member 22 is disposable and replaceable for purposes of hygiene and maximum comfort. Since the insert 22 provides a contact surface for the head of the wearer of the helmet, it would be possible to dispense with the headband 17 in certain embodiments of this invention. However, the headband 17 provides additional comfort and to this end may include a sweatband member 40 of comfort padding which may be removably attached to the headband 17 for contact with the forehead of the wearer. As best shown in FIG. 4, the headband 17 may be easily and firmly attached to the helmet by attachment means 18 comprising self-locking lugs adapted to pass through supporting elements of the headband 17 as well as slots in the inner shell 14 for anchoring in the shock absorbing padding 16.

It is believed that those skilled in the art can easily apply the teachings of this invention to helmets other than that shown in the drawing and specifically described herein. Thus, it is expected that obvious changes will be made in the structure specifically disclosed herein, some of which are suggested above, without departing from the teaching of this invention.

What is claimed is:

1. In protective headwear adapted to surround at least a substantial cranial portion of the head of the wearer and comprising a shock absorbing shell including a thin wall outer shell of tough non-brittle material, a thin wall inner shell of tough non-brittle material fitted within said outer shell and spaced therefrom and a relatively thick walled shell of shock absorbing padding filling the space between said inner and outer thin wall shells, the improvement comprising:

a recess at the inner apex of said thin wall inner shell extending substantially through the thickness of said thick wall shell of shock absorbing padding, said recess having an area which is a substantial portion only of the average area of the crown of the human skull; and an insert member comprising a generally planar member made of comfort padding and a generally planar member made of shock absorbing padding each having one major surface adhered to one major surface of the other, said member of comfort padding having major surfaces of larger area than said recess, said member of shock absorbing padding having major surfaces of smaller area than said area of said major surfaces of said member of comfort padding and centered on said one major surface thereof, and said member of shock absorbing padding being received within said recess with the exposed edges of said one major surface of said member of comfort padding on contact with the interior of said thin wall inner shell and the other major surface thereof exposed to contact by the head of the wearer.

2. The improvement in protective headwear as claimed in claim 1 wherein said generally planar member of shock absorbing padding has transverse dimensions adapted to be compressively received within said recess.

3. The improvement in protective headwear as claimed in claim 2 wherein said generally planar member of shock absorbing padding is dimensioned to substantially fill said recess.

4. The improvement in protective headwear as claimed in claim 1 wherein said recess and said insert member have the same smoothly curved transverse shape.

5. The improvement in protective headwear as claimed in claim 4 wherein said smoothly curved transverse shape is generally circular.

6. The improvement in protective headwear as claimed in claim 1 wherein said recess comprises an outwardly relieved structure formed at the inner apex of said thin wall inner shell.

7. The improvement in protective headwear as claimed in claim 6 wherein said recess and said insert have the same smoothly curved transverse shape and said outwardly relieved structure is a dome structure.

8. The improvement in protective headwear as claimed in claim 7 wherein said smoothly curved transverse shape and said dome structure are generally circular.

9. The improvement in protective headwear as claimed in claim 8 wherein said dome structure includes an outwardly extending land having an axially extending flange.

10. The improvement in protective headwear as claimed in claim 9 wherein said generally planar member made of shock absorbing padding is dimensioned to be compressively received within said axially extending flange against said outwardly extending land.

11. The improvement in protective headwear as claimed in claim 10 wherein said insert member includes an additional generally planar member made of shock absorbing padding having a major surface in contact with and centered on the free major surface of said generally planar member made of shock absorbing padding, said additional generally planar member made of shock absorbing padding being dimensioned to be received within said dome of said dome structure without contacting said land thereof.

12. The improvement in protective headwear as claimed in claim 11 wherein said additional generally planar member of shock absorbing padding is shaped and dimensioned to provide voids within said dome of said dome structure when received within said dome of said dome structure.

13. The improvement in protective headwear as claimed in claim 1 wherein a headband structure is attached to said shock absorbing shell within said thin wall inner shell.

14. The improvement in protective headwear as claimed in claim 13 wherein the transverse dimensions of said headband structure are adjustable.

15. The improvement in protective headwear as claimed in claim 1 wherein the rim of said thin wall inner shell of said shock absorbing shell is attached to the inner surface of said thin wall outer shell of said shock absorbing shell.

* * * * *